US009555818B1

(12) United States Patent
Wike et al.

(10) Patent No.: US 9,555,818 B1
(45) Date of Patent: Jan. 31, 2017

(54) SIDE BEARING FOR RAILWAY CAR TRUCK

(71) Applicant: Amsted Rail Company, Inc., Chicago, IL (US)

(72) Inventors: Paul Wike, St. Louis, MO (US); Zachary Harris, Edwardsville, MO (US)

(73) Assignee: Amsted Rail Company, Inc., Chicago, IL (US)

( * ) Notice: Subject to any disclaimer, the term of this patent is extended or adjusted under 35 U.S.C. 154(b) by 0 days.

(21) Appl. No.: 14/920,171

(22) Filed: Oct. 22, 2015

(51) Int. Cl.

| | |
|---|---|
| ***B61F 5/00*** | (2006.01) |
| ***B61F 5/14*** | (2006.01) |
| ***B61F 5/52*** | (2006.01) |
| ***B61F 5/38*** | (2006.01) |

(52) U.S. Cl.
CPC . *B61F 5/14* (2013.01); *B61F 5/38* (2013.01); *B61F 5/523* (2013.01)

(58) Field of Classification Search
CPC ..... B61F 5/14; B61F 5/142; B61F 5/144; B61F 5/148
USPC ..... 105/199.3, 199.2, 199.4
See application file for complete search history.

(56) References Cited

U.S. PATENT DOCUMENTS

| | | | | |
|---|---|---|---|---|
| 5,315,934 | A * | 5/1994 | List | B61F 5/14 105/199.3 |
| 5,806,435 | A * | 9/1998 | Pitchford | B61F 5/14 105/199.3 |
| 6,341,422 | B1 * | 1/2002 | O'Donnell | B61F 5/142 105/199.3 |
| 2004/0139878 | A1 * | 7/2004 | McKisic | B61F 5/14 105/199.3 |
| 2006/0042498 | A1 * | 3/2006 | Schorr | B61F 5/142 105/199.3 |
| 2009/0308276 | A1 * | 12/2009 | Aitken | B61F 5/14 105/199.3 |
| 2013/0327246 | A1 * | 12/2013 | Aspengren | B61F 5/142 105/199.3 |
| 2016/0152249 | A1 * | 6/2016 | Vladimirovich | B61F 5/14 105/199.3 |

* cited by examiner

*Primary Examiner* — Jason C Smith
(74) *Attorney, Agent, or Firm* — Edward J. Brosius

(57) ABSTRACT

An improved leaf spring side bearing assembly for railway freight cars is provided that achieves improved tracking and curving by the limitation of rock of the railway freight car. The side bearing comprises a base with two raised end sections. A leaf spring assembly is provided on the base that extends to the underside and support channel of the freight car. A top wear plate and a bottom travel stop are also included with the leaf spring side bearing assembly.

12 Claims, 2 Drawing Sheets

SIDE BEARING FOR RAILWAY CAR TRUCK

BACKGROUND OF THE INVENTION

The present invention relates to an improved side bearing for mounting on a railway car truck bolster that provides improved control to limit rock and roll characteristics of the railway car in service.

As shown in FIG. 1, a typical railway freight car truck 64 includes a pair of side frames 30, 32 supported on axle-wheel sets 34, 36. Bolster 38 extends between and is supported on springs 40 mounted on side frames 30, 32. Bolster center plate 28 includes a central opening 42. Side bearing pads 60 are provided laterally to each side of the center plate 28 on bolster 38. Side frames 30, 232 comprise a top member 44, compression member 46, tension member 48, column 50, pedestal 54, pedestal roof 56, wheel axle bearings 58, and bearing adapter 62. Side bearings are commonly used on railroad car trucks. Such side bearings are typically located on the truck bolster such as on side bearing pads 60, but may be located elsewhere on the bolster. Bolster 38 and side frames 30, 32 are usually unitary cast steel structures.

Typical side bearing arrangements are designed to control hunting of the railroad car. As a railroad car travels along the railroad track, a yaw excess motion can be induced in the railroad car truck. As the truck yaws, part of the side bearing is made to slide across the underside of a wear plate bolted to the railroad car body bolster. The resulting friction produces an opposing torque that acts to prevent such yaw motion. Another purpose of railroad car truck side bearings is control or limit the rock or roll motion of the car body. Most prior side bearing designs limited vertical travel of the side bearings.

Accordingly, it is an object of the present invention to provide an improved side bearing which will limit the vertical rock or roll motion of the railway freight car.

It is another object of the present invention to provide an improved side bearing which will provide improved control over the rock or roll motion of an empty railway freight car.

SUMMARY OF THE INVENTION

A side bearing is provided with improved characteristics to enhance the performance of rail cars, especially in unloaded conditions.

One embodiment of a side bearing in accordance with the present invention includes a base structure. A leaf spring assembly is positioned on the base structure. Shackles are affixed to the ends of the base by pins. Leaf spring end clamps are connected to end portions of the leaf spring assembly. The shackles are also connected to the leaf spring end clamps by pins. The pin connections with the shackles allow rotation of the leaf spring assembly in relation to the base structure. A leaf spring top clamp assembly with a top clamp and a bottom clamp joins a center top portion of the leaf spring assembly. A top wear plate is fitted between the leaf spring top clamp and the top portion of the leaf spring assembly. The leaf spring assembly has a preselected non-compressed height.

The base is usually a unitary cast steel or cast iron or plate steel structure. The leaf spring itself is usually comprised of a glass fiber reinforced polymer but can be comprised of a spring steel. The shackles are usually formed of steel, either cast, machined or stamped. The end and top clamp assemblies are usually formed of a cast steel or steel bar, but also in certain embodiments could be fabricated. A bottom stop is also provided adjacent the bottom of the top clamp.

In usual embodiments, at the compressed standard set-up height of 5 1/16 inches, the top of the leaf spring clamp will contact the support channel of the freight car under normal operating conditions for an empty and loaded railway car. In a rock condition due to curving or other forces that the freight car is being subjected to, the leaf spring assembly will be compressed past the set-up height. Such leaf spring compression will limit the rock of the railway freight car to within design parameters.

DESCRIPTION OF THE PREFERRED EMBODIMENT

Figure 1:
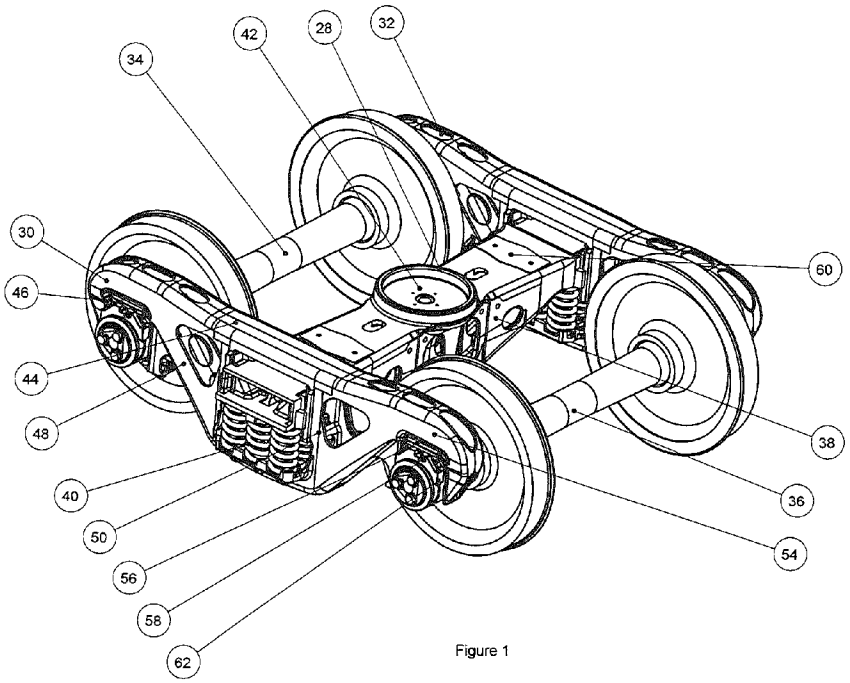
FIG. 1 is a perspective view of a typical railway freight car truck.
Figure 6:
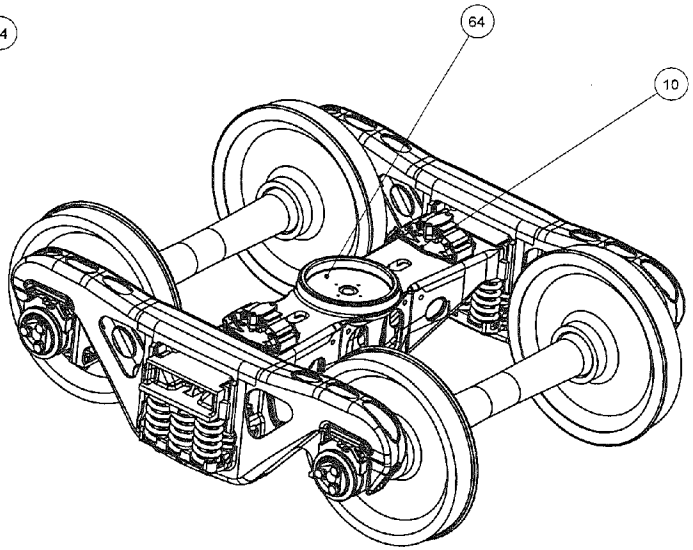
FIG. 6 is a perspective view of a typical railway freight car truck in accordance with and embodiment of the present invention.
Figure 4:
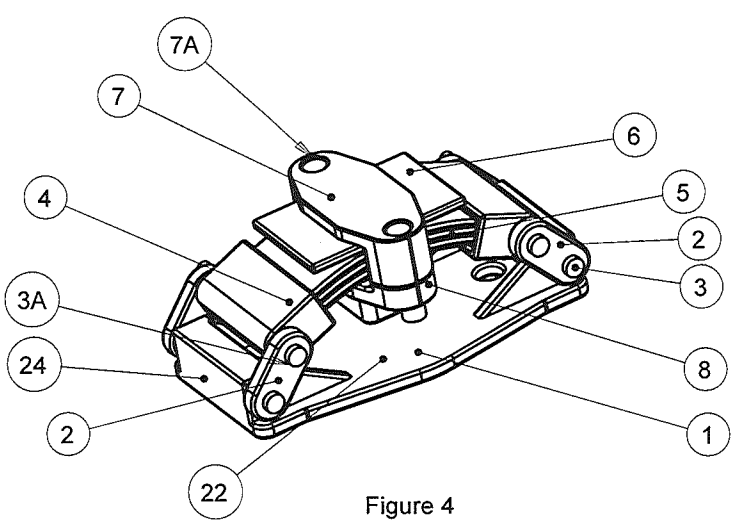
FIG. 4 is a perspective view of a leaf spring assembly side bearing in accordance with an embodiment of the present invention.
Figure 3:
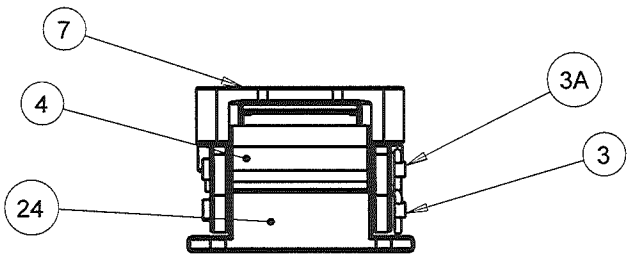
FIG. 3 is an end view of a leaf spring assembly side bearing in accordance with an embodiment of the present invention.
Figure 2:
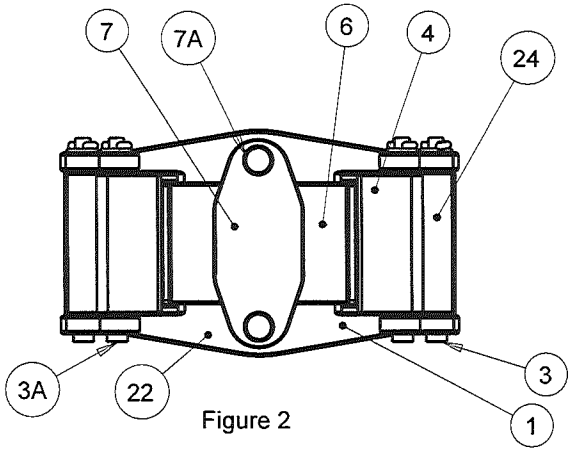
FIG. 2 is a top view of a leaf spring assembly side bearing in accordance with an embodiment of the present invention.
Figure 5:
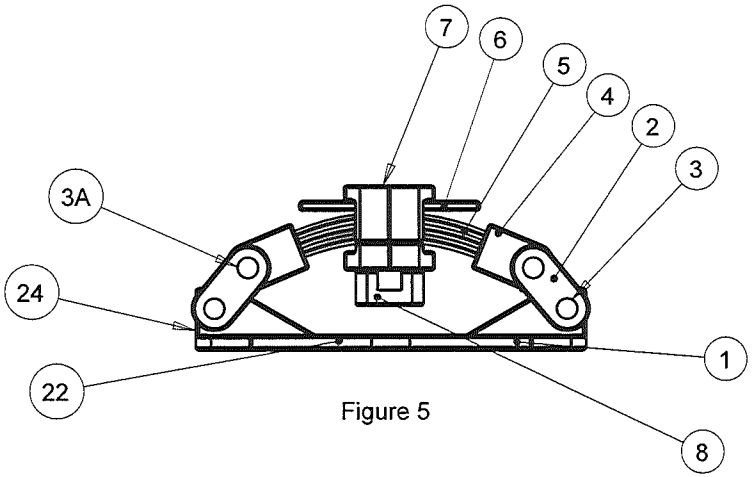
FIG. 5 is a side view of a leaf spring assembly side bearing in accordance with an embodiment of the present invention.

Referring now to FIGS. 2-6, a first embodiment of the leaf spring assembly side bearing according to the present invention is shown at 10. Side bearing assembly 10 includes a base structure 1, which is comprised of a bottom portion 22 and end structures 24 extending vertically upward from each end of bottom portion 22. Base structure 1 is usually cast steel or cast iron unitary structure, but can be a fabricated or machined steel plate as well, with end structures 24 being unitary or welded or otherwise affixed to the ends of bottom portion 22. The shape of bottom portion 22 can be somewhat rectangular, or somewhat oval or diamond shaped as the use dictates.

Bottom portion 22 of base 1 includes openings (not shown) that allow the ready attachment of base 1 to side bearing pad 60 of bolster 38 by bolts or similar devices.

Shackles 2 are used to connect base end structures 24 to leaf spring end clamps 4 by the use of pins 3. Leaf spring end clamps 4 are connected to the ends of leaf springs 5 by similar pins 3A. Shackles 2 can be cast, machined or stamped steel, and when combined with pins 3 and 3A, allow leaf springs 5 to compress and flex as the load force from the freight car is applied to the leaf spring assembly side bearing 10.

Leaf springs 5 can be comprised of a mono-leaf spring or of multiple laminated leaf springs. Leaf spring 5 elements may be made of a glass fiber reinforced polymer, or in certain applications, spring steel.

Clamps 7 are used to hold the leaf spring together at the top of the leaf springs. Clamps 7 are usually comprised of steel bar stock, which is held by bolts 7A or similar devices. Top wear plate 6 is positioned between clamp 7 and the top of leaf springs 5 to provide improved wear resistance between the bottom of the freight car support channel and leaf spring 5. Top wear plate 6 is usually made of a steel with a 10-15% manganese content.

Bottom stop 8 is placed at the bottom of clamp 7 to restrict the down travel of leaf springs 5. Bottom stop 8 is usually made of cast or machined steel, and is affixed to clamp 7 by bolts 7A. Bottom stop 8 is designed to limit the down travel of leaf springs 5 when measured at clamp 7 to no more than 0.625 inch (1.58 cm). Such limitation in the down travel of leaf spring 5 would limit the rock of the railway freight car.

What is claimed is:

1. A side bearing assembly comprising:

a base structure having two ends, four shackles, each shackle connected to one of the base structure ends, a leaf spring assembly having two ends, two leaf spring end clamps, each leaf spring end clamp connected to each end of the leaf spring assembly, each leaf spring end clamp also connected to two of the shackles, a top clamp joining a top portion of the leaf spring assembly, and a bottom stop connected to a bottom of the top clamp.

2. The side bearing assembly of claim 1 further comprising a wear plate positioned between the top portion of the leaf spring assembly and the clamp.

3. The side bearing assembly of claim 1 further comprising a first pin joining the shackle to the base structure end in a manner to allow rotation between the shackle and the base structure end.

4. The side bearing assembly of claim 1 further comprising a second pin joining the shackle to the leaf spring end clamp in a manner to allow rotation between the shackle and the leaf spring end clamp.

5. The side bearing assembly of claim 1 wherein the maximum travel of the leaf spring assembly downward from an unloaded position is less than 0.625 inch.

6. The side bearing assembly of claim 1 wherein the leaf spring assembly is comprised of a glass fiber reinforced polymer leaf spring.

7. A side bearing assembly comprising:

a base structure having two ends, a plurality of shackles, each shackle connected to one of the base structure ends, a leaf spring having two ends and a top portion, two leaf spring end clamps, with each leaf spring end clamp connected to one end of the leaf spring, each leaf spring end clamp also connected to two of the shackles, a top clamp joining the top portion of the leaf spring, and a bottom stop connected to a bottom of the top clamp.

8. The side bearing assembly of claim 7 further comprising a wear plate positioned between the top portion of the leaf spring and the top clamp.

9. The side bearing assembly of claim 7 further comprising a first pin joining the shackle to the base structure end in a manner to allow rotation between the shackle and the base structure end.

10. The side bearing assembly of claim 7 further comprising a second pin joining the shackle to the leaf spring end clamp in a manner to allow rotation between the shackle and the leaf spring end clamp.

11. The side bearing assembly of claim 7 wherein the maximum travel of the top portion of the leaf spring downward from an unloaded position is less than 0.625 inch.

12. The side bearing assembly of claim 7 wherein the leaf spring is comprised of a glass fiber reinforced polymer leaf spring.

* * * * *